US010711492B2

(12) United States Patent
Cumbo et al.

(10) Patent No.: US 10,711,492 B2
(45) Date of Patent: Jul. 14, 2020

(54) VEHICULAR LATCH WITH DOUBLE PAWL ARRANGEMENT

(71) Applicant: Magna Closures Inc., Newmarket (CA)

(72) Inventors: Francesco Cumbo, Pisa (IT); Marco Taurasi, Leghorn (IT)

(73) Assignee: MAGNA CLOSURES INC., Newmarket (CA)

( * ) Notice: Subject to any disclaimer, the term of this patent is extended or adjusted under 35 U.S.C. 154(b) by 544 days.

(21) Appl. No.: 15/707,075

(22) Filed: Sep. 18, 2017

(65) Prior Publication Data

US 2018/0016821 A1 Jan. 18, 2018

Related U.S. Application Data

(63) Continuation of application No. 13/577,059, filed as application No. PCT/CA2010/001890 on Nov. 26, 2010, now Pat. No. 9,765,554.

(Continued)

(51) Int. Cl.
*E05B 81/14* (2014.01)
*E05B 81/70* (2014.01)

(Continued)

(52) U.S. Cl.
CPC ..... *E05B 81/14* (2013.01); *E05B 81/70* (2013.01); *E05B 85/26* (2013.01); *E05B 77/06* (2013.01);

(Continued)

(58) Field of Classification Search
CPC ..... E05B 81/14; E05B 81/70; E05B 81/90; E05B 85/26; E05B 77/06;

(Continued)

(56) References Cited

U.S. PATENT DOCUMENTS 4,518,180 A * 5/1985 Kleefeldt ..... E05B 81/06 292/201
4,904,006 A * 2/1990 Hayakawa ..... E05B 81/06 292/201

(Continued)

FOREIGN PATENT DOCUMENTS

GB 2334297 A 8/1999
WO 200102677 A2 1/2001

(Continued)

OTHER PUBLICATIONS

European Search Report for corresponding EP Application No. 19182342.6-1005 dated Dec. 9, 2019.

(Continued)

*Primary Examiner* — Kristina R Fulton
*Assistant Examiner* — Faria F Ahmad
(74) *Attorney, Agent, or Firm* — Dickinson Wright PLLC

(57) ABSTRACT

A low release effort eccentric double pawl vehicle latch includes a ratchet, primary pawl, auxiliary ratchet and secondary pawl in combination with a secure lock lever. The secure lock lever selectively inhibits movement of the secondary pawl to prevent premature or unintended opening of the latch. A drive mechanism sequences movement of the secure lock lever and secondary pawl to open the latch. Upon reset, the drive mechanism drives the auxiliary ratchet back to its closed state and in the process the auxiliary ratchet can engage and return the secondary pawl back to a closed state in the event of an insufficient bias force thereon.

20 Claims, 10 Drawing Sheets

Related U.S. Application Data

(60) Provisional application No. 61/301,647, filed on Feb. 5, 2010.

(51) Int. Cl.
*E05B 85/26* (2014.01)
*E05B 77/06* (2014.01)
*E05B 81/90* (2014.01)

(52) U.S. Cl.
CPC ..... *E05B 81/90* (2013.01); *Y10S 292/23* (2013.01); *Y10T 292/108* (2015.04); *Y10T 292/1047* (2015.04); *Y10T 292/1079* (2015.04); *Y10T 292/1082* (2015.04); *Y10T 292/1092* (2015.04)

(58) Field of Classification Search
CPC ..... Y10T 292/1079; Y10T 292/108; Y10T 292/1078; Y10T 292/1048; Y10T 292/1082; Y10T 292/1092; Y10T 292/1047; Y10S 292/23
See application file for complete search history.

(56) References Cited

U.S. PATENT DOCUMENTS 4,974,886 A * 12/1990 Kleefeldt ..... E05B 81/06 292/201
5,409,277 A * 4/1995 Rogers, Jr. ..... E05B 77/24 292/201
5,441,315 A * 8/1995 Kleefeldt ..... E05B 81/25 292/201
5,474,338 A 12/1995 Buscher
5,722,272 A * 3/1998 Bridgeman ..... E05B 81/16 70/264
5,802,894 A 9/1998 Jahrsetz et al.
5,865,481 A * 2/1999 Buschmann ..... E05B 77/06 292/216
5,868,444 A * 2/1999 Brackmann ..... E05B 81/20 292/196
5,934,717 A 8/1999 Wirths et al.
5,938,253 A 8/1999 Szablewski et al.
5,997,055 A 12/1999 Strathmann
6,007,117 A * 12/1999 Spindler ..... E05B 17/042 292/199
6,048,002 A 4/2000 Ohta et al.
6,076,868 A 6/2000 Roger, Jr. et al.
6,382,687 B1 * 5/2002 Gruhn ..... E05B 81/14 292/201
6,390,517 B1 * 5/2002 Ehret ..... E05B 81/14 292/201
6,526,790 B2 * 3/2003 Wegner ..... E05B 81/06 292/201
6,536,814 B2 * 3/2003 Kachouh ..... E05B 81/14 292/201
6,557,688 B2 * 5/2003 Minasian ..... E05B 81/25 192/223
6,557,910 B2 * 5/2003 Amano ..... E05B 81/14 292/201
6,575,507 B2 * 6/2003 Reddmann ..... E05B 81/14 292/201
6,598,911 B2 * 7/2003 Mejean ..... E05B 81/14 292/201
6,824,177 B1 11/2004 Nass et al.
6,863,318 B2 * 3/2005 Mejean ..... E05B 81/14 292/199
6,866,311 B2 * 3/2005 Spurr ..... E05B 83/16 292/201
6,923,480 B2 * 8/2005 Shafry ..... E05B 81/25 292/201
7,032,937 B2 * 4/2006 Boecker ..... E05B 81/14 292/201
7,059,640 B2 * 6/2006 Tensing ..... E05B 81/14 292/201
7,140,651 B2 * 11/2006 Brose ..... E05B 81/14 292/216
7,192,066 B2 * 3/2007 Ilea ..... E05B 81/25 292/201
7,234,736 B2 * 6/2007 Kachouh ..... E05B 81/14 292/201
7,261,334 B2 * 8/2007 Oberheide ..... E05B 81/14 292/201
7,384,080 B2 * 6/2008 Kachouh ..... E05B 81/14 292/201
7,434,852 B2 * 10/2008 Spurr ..... E05B 85/26 292/201
7,451,799 B2 * 11/2008 Sanchez ..... E06B 9/86 160/133
7,452,013 B2 11/2008 Kachouh et al.
7,475,922 B2 1/2009 Ottino et al.
7,815,230 B2 * 10/2010 Yoshikuwa ..... E05B 81/25 292/201
8,141,916 B2 * 3/2012 Tomaszewski ..... E05B 77/26 292/201
8,328,249 B2 * 12/2012 Corrales ..... E05B 81/14 292/201
8,448,999 B2 * 5/2013 Grifoll ..... E05B 81/14 292/201
8,474,888 B2 * 7/2013 Tomaszewski ..... E05B 77/26 292/201
8,596,694 B2 12/2013 Taurasi et al.
8,615,929 B2 * 12/2013 Lee ..... E05F 15/614 49/334
8,757,679 B2 * 6/2014 Torkowski ..... E05B 85/26 292/201
8,757,682 B2 * 6/2014 Scholz ..... E05B 81/20 292/201
8,764,075 B2 * 7/2014 Taurasi ..... E05B 81/14 292/201
2001/0010427 A1 8/2001 Roos
2002/0017792 A1 2/2002 Raffelsiefer et al.
2002/0070564 A1 * 6/2002 Ohta ..... E05B 81/20 292/201
2002/0096889 A1 * 7/2002 Nelsen ..... E05B 81/14 292/201
2002/0158475 A1 * 10/2002 Rice ..... E05B 81/14 292/216
2003/0038485 A1 * 2/2003 Schwaiger ..... E05B 81/14 292/201
2003/0178858 A1 * 9/2003 Spurr ..... E05B 83/16 292/217
2004/0056489 A1 3/2004 Boecker et al.
2004/0094971 A1 * 5/2004 Warmke ..... E05B 81/06 292/201
2004/0113438 A1 6/2004 Kachouh
2004/0130163 A1 * 7/2004 Kachouh ..... E05B 81/06 292/201
2004/0135378 A1 7/2004 Buedding et al.
2004/0174021 A1 * 9/2004 Tensing ..... E05B 81/14 292/216
2004/0232707 A1 11/2004 Kachouh
2004/0245786 A1 * 12/2004 Hashiba ..... E05B 81/14 292/216
2006/0076784 A1 4/2006 Kachouh et al.
2006/0226661 A1 * 10/2006 Moore ..... E05B 81/20 292/216
2007/0007774 A1 * 1/2007 Stefanic ..... E05B 81/14 292/216
2007/0029814 A1 2/2007 Coleman et al.
2007/0090654 A1 * 4/2007 Eaton ..... E05B 81/16 292/201
2008/0073915 A1 * 3/2008 Hunt ..... E05B 81/06 292/201
2008/0105011 A1 * 5/2008 Machida ..... E05B 81/20 70/237
2008/0203737 A1 * 8/2008 Tomaszewski ..... E05B 77/26 292/216
2008/0224482 A1 9/2008 Cumbo et al.

(56) References Cited

U.S. PATENT DOCUMENTS

2009/0236863 A1* 9/2009 Akizuki ..... E05B 81/14 292/201
2009/0295174 A1 12/2009 Corrales et al.
2010/0117379 A1* 5/2010 Mitchell ..... E05B 81/14 292/216
2010/0235057 A1* 9/2010 Papanikolaou ..... E05B 81/14 701/49
2010/0235058 A1* 9/2010 Papanikolaou ..... E05B 77/42 701/49
2010/0235059 A1* 9/2010 Krishnan ..... E05B 81/64 701/49
2010/0244466 A1* 9/2010 Tomaszewski ..... E05B 85/01 292/201
2010/0320777 A1* 12/2010 Jankowski ..... E05B 77/06 292/200
2012/0068479 A1 3/2012 Bendel et al.
2014/0035295 A1 2/2014 Bendel et al.
2014/0049056 A1 2/2014 Scholz et al.
2014/0091581 A1 4/2014 Taurasi et al.
2014/0132008 A1 5/2014 Bendel et al.
2014/0175813 A1* 6/2014 Margheritti ..... E05B 77/34 292/201

FOREIGN PATENT DOCUMENTS

WO WO0102677 A2 1/2001
WO 2009143997 A1 3/2009
WO WO2009143997 A1 12/2009

OTHER PUBLICATIONS

International Search Report for PCT/CA2010/001890 (in English), dated Mar. 25, 2011.

* cited by examiner

VEHICULAR LATCH WITH DOUBLE PAWL ARRANGEMENT

CROSS-REFERENCE TO RELATED APPLICATIONS

This application is a continuation of U.S. patent application Ser. No. 13/577,059 filed Aug. 22, 2012, which is a U.S. national phase of PCT/CA2010/001890, filed Nov. 26, 2010 and published in English as WO/2011/094834 on Aug. 11, 2011, which claims priority from U.S. Provisional Patent Application No. 61/301,647, filed Feb. 5, 2010. The entire disclosures of each of the above applications are incorporated herein by reference.

FIELD OF THE INVENTION

The invention generally relates to the art of vehicular latches and more specifically vehicular latches that utilize double pawl arrangements.

BACKGROUND OF THE INVENTION

Double pawl arrangements are known in the latching art. The double pawl arrangement may utilize a first pawl and ratchet set connected to a second pawl and ratchet. The connection may be configured such that only a portion of the forces experienced by the first pawl and ratchet set are applied to the second pawl and ratchet set, thus requiring only a relatively low effort to release the latch. While this is desirable, it also leads to the problem that an unbalanced force may unintentionally release the latch in unintended circumstances such as a crash situation. It would be desirable to preclude such events.

In addition, in double pawl arrangements both pawls must be reset to their locked positions. Biasing means such as springs are conventionally employed for such purpose. But over time, these biasing forces may degrade, or may be insufficient occasionally to cope with other impediments to returning the pawls to their respective locked positions. An elegant, low cost solution is sought to such problems.

SUMMARY OF THE INVENTION

One broad aspect of the invention relates to a vehicle latch having a ratchet, primary pawl, auxiliary ratchet and secondary pawl in combination with a secure lock lever selectively inhibiting movement of the secondary pawl to prevent premature or unintended opening of the latch. A drive mechanism sequences movement of the secure lock lever and secondary pawl to open the latch.

According to this aspect of the invention the ratchet is movable between a striker release position wherein the ratchet is positioned to receive a striker and a striker capture position wherein the ratchet is positioned to retain the striker, the ratchet being biased towards the striker release position. The primary pawl is movable between a ratchet checking position wherein the primary pawl is positioned to keep the ratchet in the striker capture position and a ratchet release position wherein the primary pawl permits the movement of the ratchet out of the striker capture position, the primary pawl being biased towards the ratchet checking position. The auxiliary ratchet is operatively connected to the primary pawl, and is movable between an enabling position in which the primary pawl is enabled to move to its ratchet checking position and a disabling position in which the auxiliary ratchet positions the primary pawl to its ratchet release position. The secondary pawl is movable between an auxiliary ratchet holding position, in which the secondary pawl is positioned to hold the auxiliary ratchet in its enabling position, and an auxiliary ratchet release position, in which the secondary pawl is positioned to permit movement of the auxiliary ratchet to its disabling position, the secondary pawl being biased to the auxiliary ratchet holding position. The secure lock lever is movable between a locking position, wherein the secure lock lever prohibits movement of the secondary pawl out of its auxiliary ratchet holding position, and a releasing position, wherein the secure lock lever enables movement of the secondary pawl into its auxiliary ratchet release position, the secure lock lever being biased to the locking position. The drive mechanism includes a gear wheel for moving the secure lock lever into its releasing position and then moving the secondary pawl into its auxiliary ratchet release position in order to open the latch.

Another broad aspect of the invention relates to a latch having a ratchet, primary pawl, auxiliary ratchet and secondary pawl. A drive mechanism interfaces with the secondary pawl and auxiliary ratchet to open and close the latch. The auxiliary ratchet is configured to engage and move the secondary pawl upon closing.

According to this aspect of the invention the ratchet is movable between a striker release position wherein the ratchet is positioned to receive a striker and a striker capture position wherein the ratchet is positioned to retain the striker, the ratchet being biased towards the striker release position. The primary pawl is movable between a ratchet checking position wherein the primary pawl is positioned to keep the ratchet in the striker capture position and a ratchet release position wherein the primary pawl permits the movement of the ratchet out of the striker capture position. The auxiliary ratchet is operatively connected to the primary pawl and is movable between an enabling position in which the primary pawl is enabled to move to its ratchet checking position and a disabling position in which the auxiliary ratchet positions the primary pawl to its ratchet release position. A secondary pawl is movable between an auxiliary ratchet holding position, in which the secondary pawl is positioned to hold the auxiliary ratchet in its enabling position, and an auxiliary ratchet release position, in which the secondary pawl is positioned to permit movement of the auxiliary ratchet to its disabling position, the secondary pawl being biased to the auxiliary ratchet holding position. The drive mechanism moves the secondary pawl into its auxiliary ratchet release position in a process of opening the latch and later moves the auxiliary ratchet into its enabling position in a process of closing the latch. The auxiliary ratchet is configured to engage and move the secondary pawl into its auxiliary ratchet holding position as the auxiliary ratchet moves towards its enabled position.

BRIEF DESCRIPTION OF THE DRAWINGS

The foregoing and other aspects of the invention will be more readily appreciated having reference to the drawings, wherein.

DETAILED DESCRIPTION OF PREFERRED EMBODIMENTS

Figure 1A:
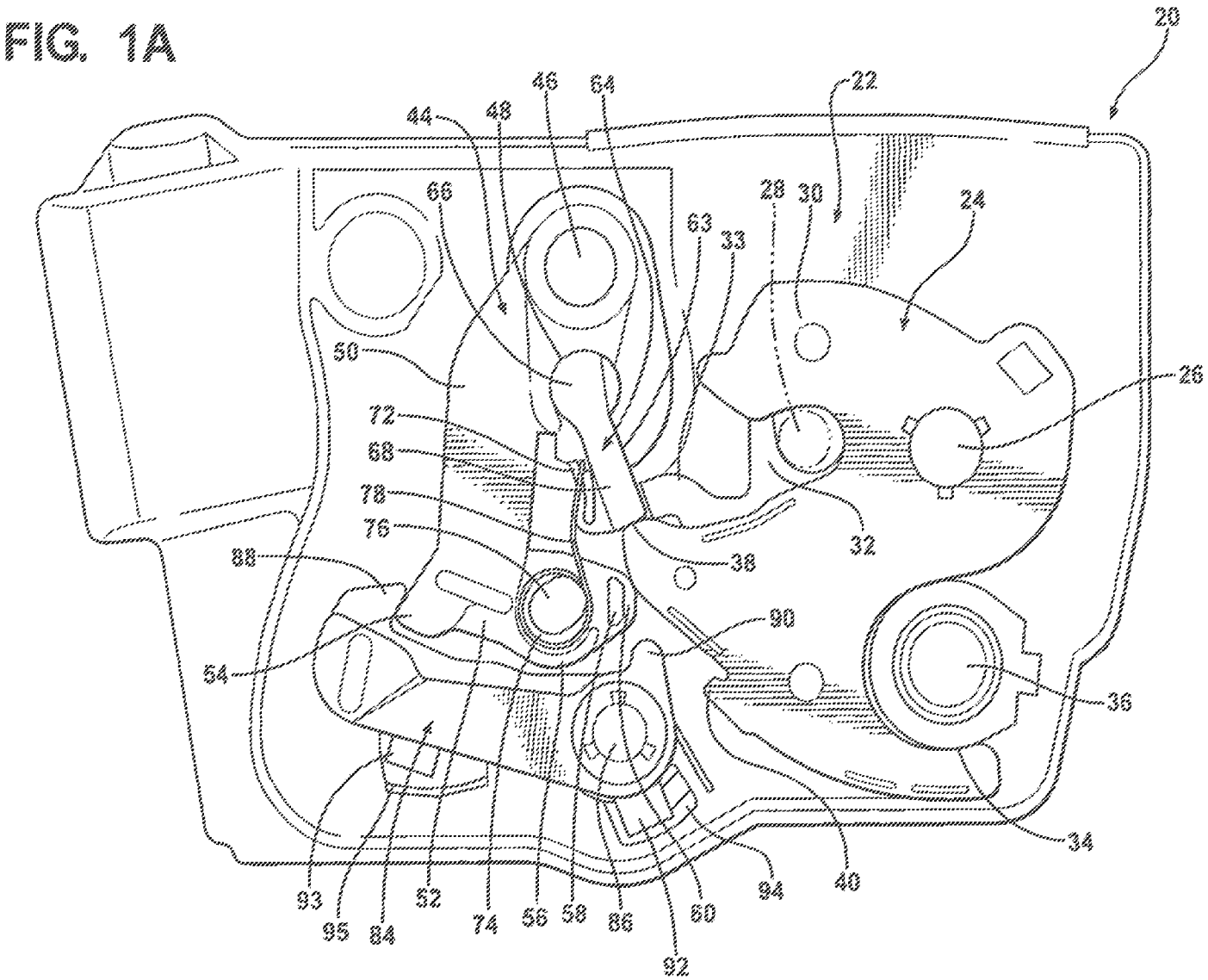
FIG. 1A is a front view of a latch with a front cover removed from view.

FIG. 1A is a front view of an electric latch 20 that includes a housing 22 in which a ratchet 24 is pivotally mounted for rotation about a pin 26 mounted in the housing 22. The ratchet 24 pivots between a fully closed or striker capture position wherein a striker 28 (shown schematically in stippled lines) is captured by a hook 30 or claw of the ratchet 24, as shown in FIG. 1A, and an open or striker release position wherein the striker 28 is not trapped by the hook or claw 30 and free to move out of the slot presented by the hook or claw. (In the orientation of FIG. 1A the ratchet 24 will rotate clockwise to move into the open or striker release position.)

The ratchet 24 is biased to the open position via a biasing spring (not shown). A striker bumper 32 is mounted in the housing 22 (underneath the ratchet 24) to cushion against the striker force of impact and a ratchet bumper 34 is also mounted about a post 36 presented in the housing 22 to cushion against the ratchet force of impact.

An auxiliary ratchet 44, which may be alternatively referred to as a cam, is also pivotally mounted in the housing 22 via a pin 46 for movement between a closed or enabling position where the auxiliary ratchet abuts the ratchet 24, as shown in FIG. 1A, and an open or disabling position, as discussed in greater detail below. (In the orientation of FIG. 1A the auxiliary ratchet 44 will rotate clockwise to enter the open or disabling position.)

The auxiliary ratchet 44 includes a cylindrical bore 48 for pivotally mounting a primary pawl 64. The primary pawl 64 includes a cylindrical stub 66 for pivotally mounting it into the bore 48 of the auxiliary ratchet 44—and not the housing 22. This provides a very simple means for mounting the primary pawl 64, which may be formed from a simple stamped or sintered metal piece.

The auxiliary ratchet 44 also includes a leg 50 which terminates in an anvil 52 having a check shoulder 54 and a cam lip 56. The auxiliary ratchet 44 is preferably encapsulated with an elastomeric material and features a hollow 58 so as to provide an elastically deformable band 60 for contacting and absorbing impact against the ratchet 24.

Figure 1B:
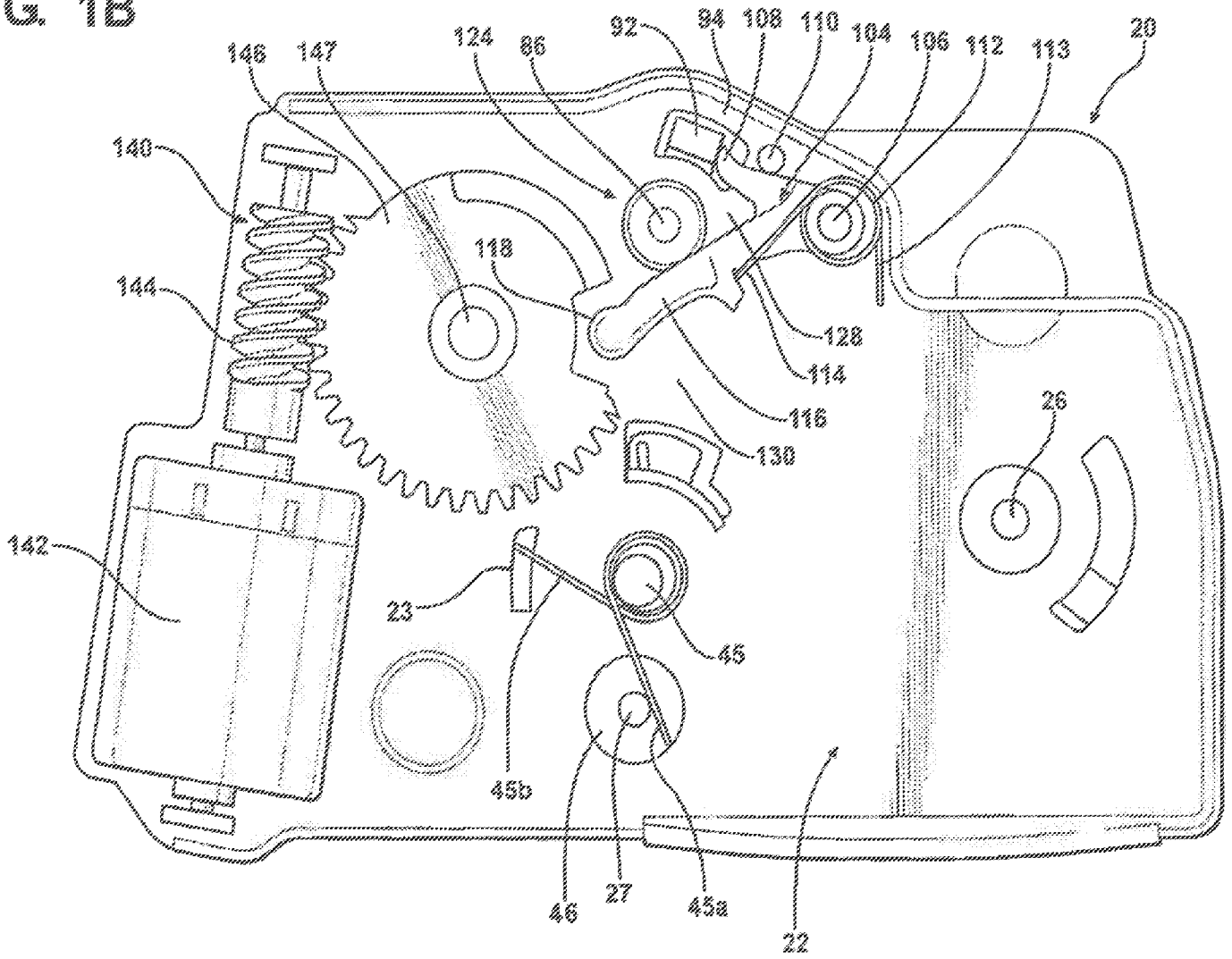
FIG. 1B is a rear view of the latch with a rear cover removed from view.

As seen in the rear or opposing view of FIG. 1B, in the present embodiment a biasing spring 45 located on the opposing side of the housing 22 biases the auxiliary ratchet 44 to the open or disabling position. The spring 45 features a first tang 45*a* abutting a capstan 27 of pin 46 and a second tang 45*b* at an opposite end of the spring 45 which cooperates with a fork (not shown) in the auxiliary ratchet 44 via a slot 23 formed in the housing 22. In alternative embodiments the biasing spring 45 may bias the auxiliary ratchet 45 towards the closed position as discussed in greater detail below.

Referring back to FIG. 1A, the primary pawl 64 includes a check arm 68 extending from the stub 66. The check arm 68 pivots between a closed or ratchet checking position in which the check arm 68 stops the opening urge of the ratchet 24, as shown in FIG. 1A, and an open or ratchet release position in which the check arm 68 does not inhibit rotation of the ratchet 24 to its open or striker release position. (In the orientation of FIG. 1A the primary pawl 64 will rotate clockwise to move into the open or ratchet release position.)

The angular sweep range of the check arm 68 is limited on one side by an edge 63 in the auxiliary ratchet 44 and on the other side by the auxiliary ratchet leg 50. A proboscis bumper 72 formed from an encapsulation of the primary pawl 64 may be provided to cushion impact of check arm 68 against the auxiliary ratchet leg 50. And an extension 33 of the striker bumper 32 may be provided to reduce or cushion impact of check arm 68 against the auxiliary ratchet edge 63.

The primary pawl 64 is preferably biased to the closed or ratchet checking position by a spring 74 wrapped around a post 76 provided in the anvil 52 of the auxiliary ratchet 44. One tang (not visible in FIG. 1A) of the spring 74 rides against the auxiliary ratchet leg 50, and another tang 78 abuts the check arm 68 of the primary pawl 64. As the biasing spring 74 is mounted to the auxiliary ratchet 44 rather than the fixed housing 22, the biasing forces on the primary pawl 64 will not vary appreciably as the auxiliary ratchet 44 rotates.

The ratchet 24 features primary and secondary shoulders 38 and 40 that interact with the check arm 68 of the primary pawl 64. Primary shoulder 38 provides a fully closed and locked position of the ratchet 24 in which the striker 28 is securely ensconced in the hook or claw 30 of the ratchet 24 such that the vehicle door (not shown) is completely closed and door seals (not shown) are compressed. Secondary shoulder 40 provides a partially closed and locked position of the ratchet 24 wherein the striker 28 is loosely secured in the hook 30 of the ratchet 24 such that the vehicle door is locked but not completely closed against its seals.

An auxiliary or secondary pawl 84 is also pivotally mounted in the housing 22 about a pin 86 for movement between a closed or auxiliary ratchet holding position where the secondary pawl 84 checks the opening movement of the auxiliary ratchet 44, as shown in FIG. 1A, and an open or auxiliary ratchet release position. (In the orientation of FIG. 1A the primary pawl 84 will rotate counterclockwise to enter the open or auxiliary ratchet release position.) The secondary pawl 84 features a hook shoulder 88 for engaging the auxiliary ratchet check shoulder 54 and a protrusion 90, the purpose of which will be discussed below. The secondary pawl 84 also includes a first bent tab 92 that projects through an aperture 94 formed in the housing 22 and a second bent tab 93 that projects through another aperture 95 in the housing 22, the purpose of which are also discussed below.

The secondary pawl 84 is biased to the closed or auxiliary ratchet holding position by a spring 96 (seen partially in FIG. 3) disposed about pin 86.

Figure 3:
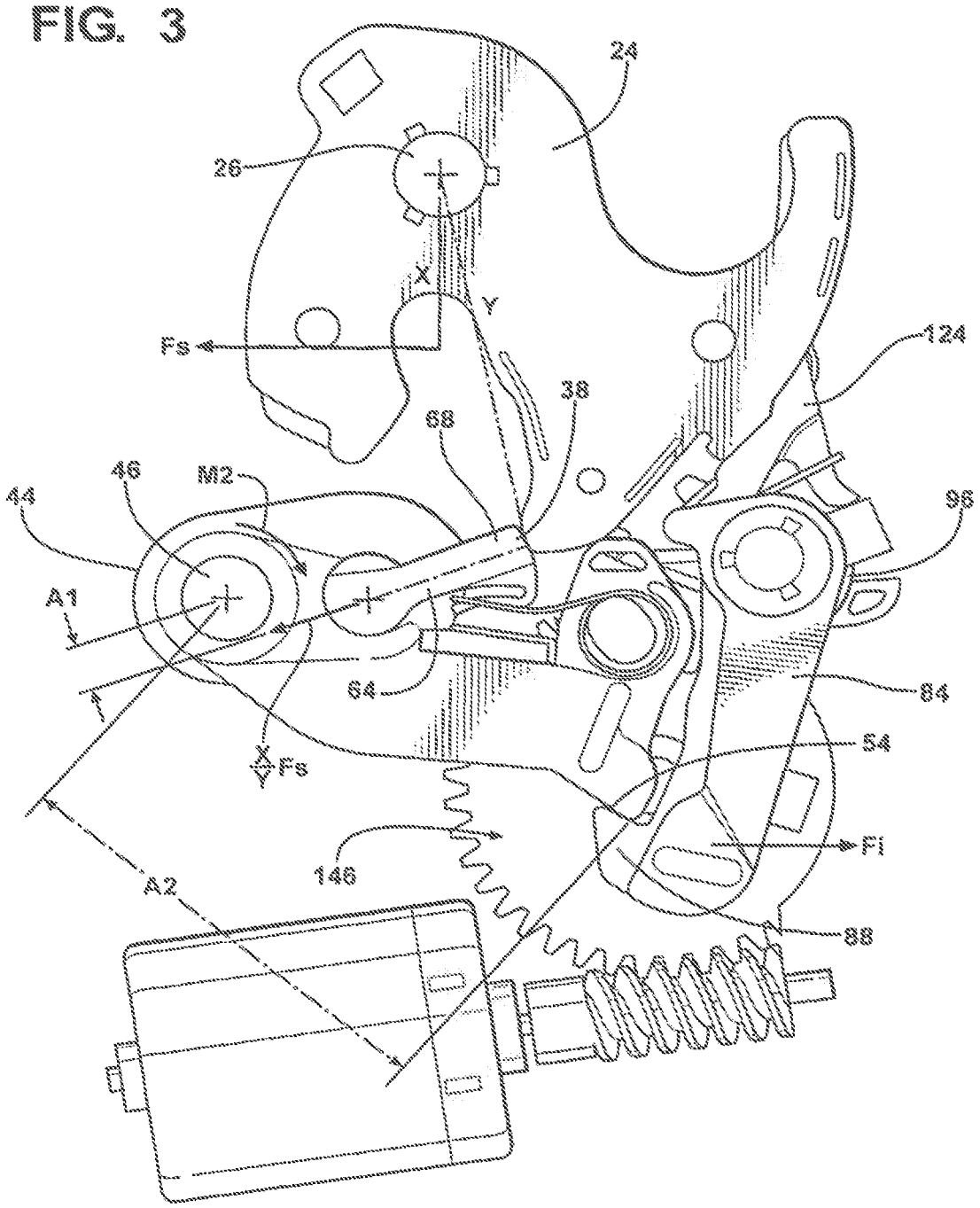
FIG. 3 is a schematic diagram illustrating various forces in the latch.
Figure 4:
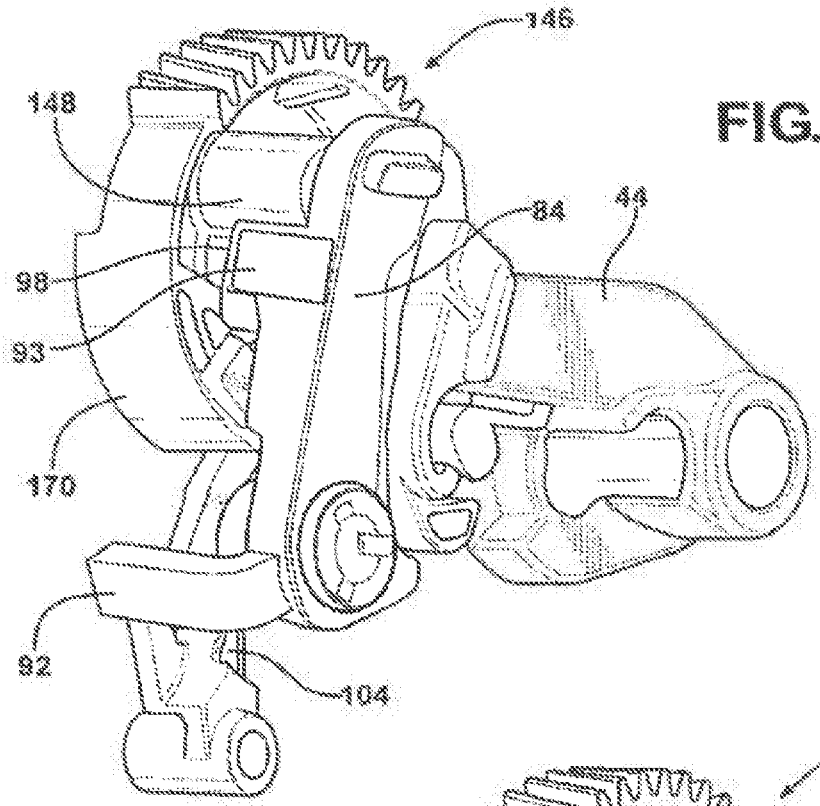
FIG. 4 is a perspective view of an isolated portion of the latch, specifically of a gear wheel interacting with a variety of levers.
Figure 5:
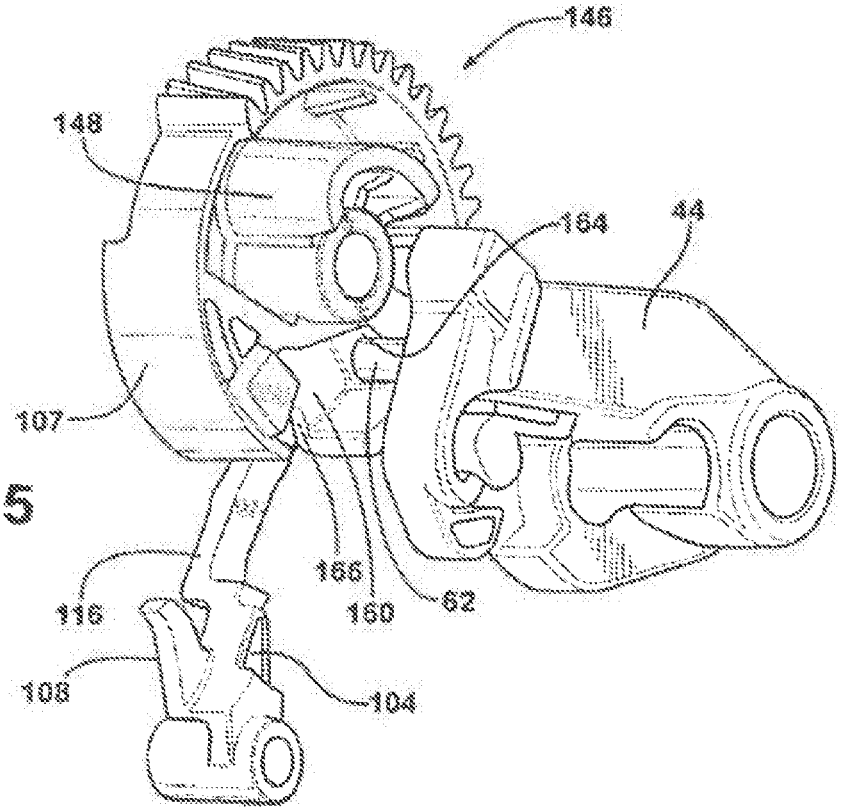
FIG. 5 is the same perspective view of the latch portion as in FIG. 4 but with one of the levers shown in FIG. 4 removed from view.

It will thus be seen from the foregoing that the latch 20 provides an eccentric double pawl arrangement for lowering release efforts. More particularly, as illustrated in FIG. 3, there exists a force Fs on the ratchet 24 that is a reaction to the seal force when the vehicle door is closed. The force Fs along with the ratchet bias force presents a moment M1 on the ratchet 24. The force necessary to move the primary pawl 64 will thus be related to the coefficient of friction between check arm 68 and ratchet shoulder 38 multiplied by a force approximately X/Y of Fs, where X is the radial distance between the striker and the ratchet pivot point (at pin 26) and Y is the distance between the primary pawl/ratchet contact area and the ratchet pivot point. In practice, the ratio X/Y could be about 40%. Similarly, the force X/Y*Fs applied to the primary pawl 68 presents a moment M2 about the auxiliary ratchet 44. The force necessary to move the secondary pawl 84 will thus be related to the coefficient of friction between secondary pawl hook shoulder 88 and auxiliary ratchet check shoulder 54 multiplied by a force approximately A1/A2 of X/Y*Fs, where A1 is the radial distance between the force on the primary pawl 64 and the auxiliary ratchet pivot point (at pin 46) and A2 is the radial distance between the secondary pawl/auxiliary ratchet contact area and the auxiliary ratchet pivot point. In practice, the ratio A1/A2 can be as low as 10-20%. Thus, a relatively low release effort may be required to open the latch 20.

Referring additionally to the rear or opposite side view of the latch 20 in FIG. 1B, the latch 20 includes a secure lock lever 104 pivotally mounted about a post 106 provided in the housing 22. The secure lock lever 104 pivots between a locking position wherein, as shown in FIG. 1B, a thumb 108 of the lock lever engages the bent tab 92 of the secondary pawl 84 in order to check movement of the secondary pawl 84 into its open position, and a releasing position, wherein the thumb 108 does not prohibit movement of the secondary pawl 84 into its open position. (In the orientation of FIG. 1B the secure lock lever 104 will pivot counterclockwise to move into its releasing position.)

A spring 112 including a first tang 113 supported by the housing 22 and a second tang 114 riding against the secure lock lever 104 biases the secure lock lever 104 into its locking position. A small bumper 110 mounted to the housing 22 sets an angular limit for the secure lock lever 104 in order to align its thumb 108 with the secondary pawl tab 92 when the secure lock lever 104 is in its locking position.

The secure lock lever 104 features a forked design that includes a longer finger 116 opposing the thumb 108. The finger 116 has a bulbous end 118 that cooperates with a gear assembly 140 as discussed in greater detail below.

The gear assembly 140 includes an electric motor 142 nestled in a compartment formed in the housing 22. The motor 142 is controlled by an electronic controller (not shown) which is preferably contained in the latch for applying power to the motor to selectively drive it. The motor 142 drives a worm gear 144 which, in turn, drives a gear wheel 146 that is nestled in another compartment in the housing and is mounted for rotation about a post 147 provided therein.

Referring additionally to the perspective views of FIGS. 4, 5, 6A and 6B, which show various parts of the latch 20 in isolation, it will be seen that the gear wheel 146 interacts with the auxiliary ratchet 44, the secondary pawl 84 and the secure lock lever 104. More particularly, as seen best in FIG. 4, the gear wheel 146 includes a push block 148 that extends axially from a discus 150 of the gear wheel 146. The push block 148 engages a depending wedge-shaped abutment 98 of the secondary pawl 84 that is located inboard of, and supported by, metal tab 93 of the secondary pawl 84. The housing aperture 95 (FIG. 1A) is sized to permit required movement of the secondary pawl tab 93 and depending abutment 98. As seen best in FIGS. 5, 6A & 6B, the gear wheel 146 also includes a first well 160 in the discus 150 that accommodates a depending post 62 of the auxiliary ratchet 44. The first well 160 includes radial push surfaces 162, 164 at opposing circumferential ends thereof. The gear wheel 146 also includes a second well 166 that is partially co-located with the first well 160 but at an axially different level or plane than the first well 160. The second well 166 has a radial cam surface 168 (seen best in FIG. 6B) that at times engages the bulbous end 118 of the secure lock lever 104 as discussed below. The gear wheel 146 also features a circumferential guide surface 170 that at times engages the bulbous end 118 of the secure lock lever 104 as discussed below.

In operation, in the closed or auxiliary ratchet holding position as seen in FIGS. 1A and 3, the secondary pawl 84 can be subject to an inertia force Fi (see FIG. 3) that may occur, for example, in the event of a crash. The force Fi, which does not need to be particularly high given the low release efforts required to open the latch as discussed above, will tend to open the secondary pawl 84. However, as seen best in FIG. 1B, the thumb 108 of the secure lock lever 104 advantageously prevents the secondary pawl 84 from pivoting into its open or auxiliary ratchet release position.

Figure 7:
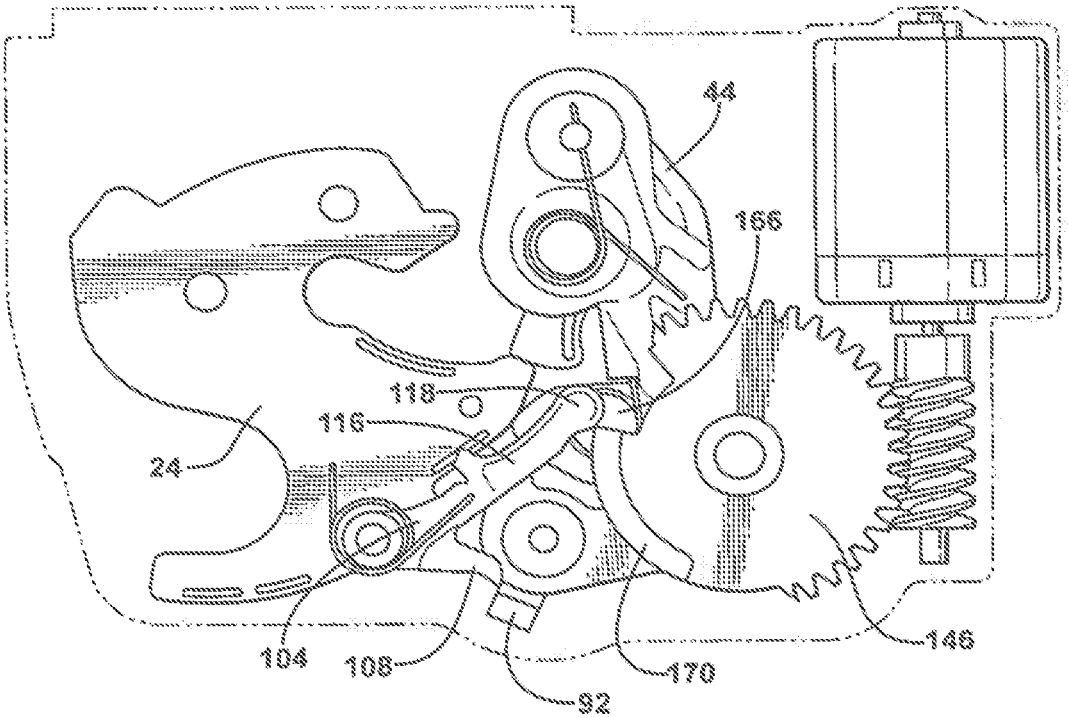
FIG. 7 is a partial rear view of the latch in a partially actuated state of opening the latch.

To open the latch 20 from the fully closed position shown in FIG. 1A, a controller (not shown) powers the gear assembly 140 to cause the gear wheel 146 to rotate (clockwise in the orientation of FIG. 1B). As shown in rear image view of FIG. 7 (in which orientation the gear wheel 146 also rotates clockwise), the cam surface 168 of the gear wheel 146 initially pushes on the bulbous end 118 of finger 116 to move the secure lock lever 104 out of the second gear wheel well 166. Consequently, the secure lock lever thumb 108 is moved out of its blocking position, no longer aligned with tab 92, thus enabling the secondary pawl 84 to pivot to its open or auxiliary ratchet release position.

Figure 8:
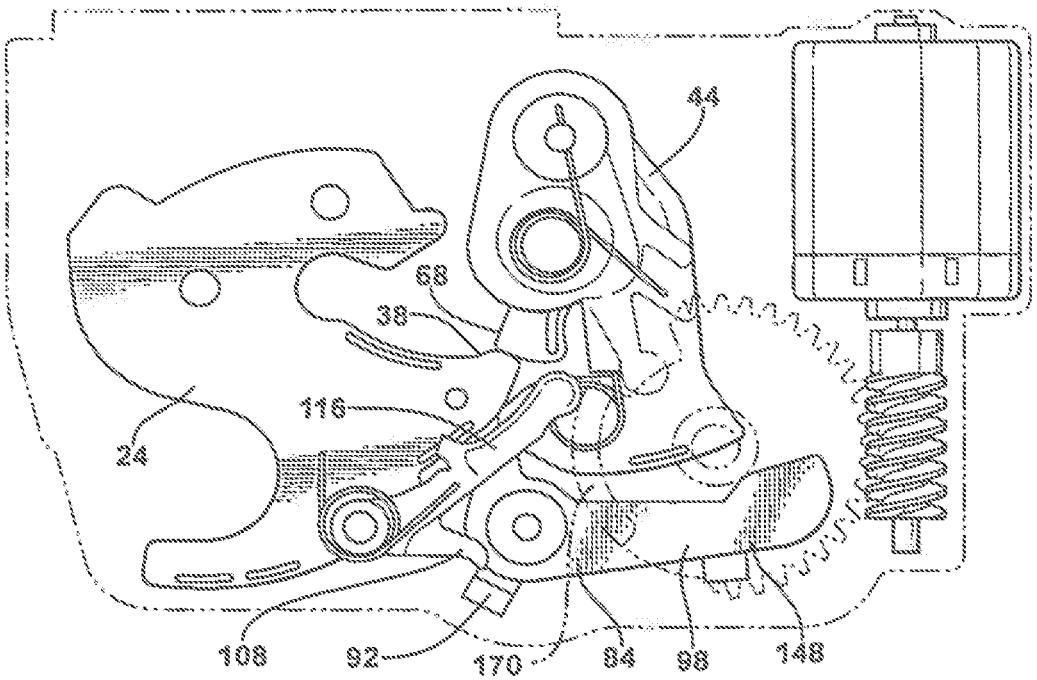
FIG. 8 is a partial rear view of the latch in a second partially actuated state of opening.
Figure 9:
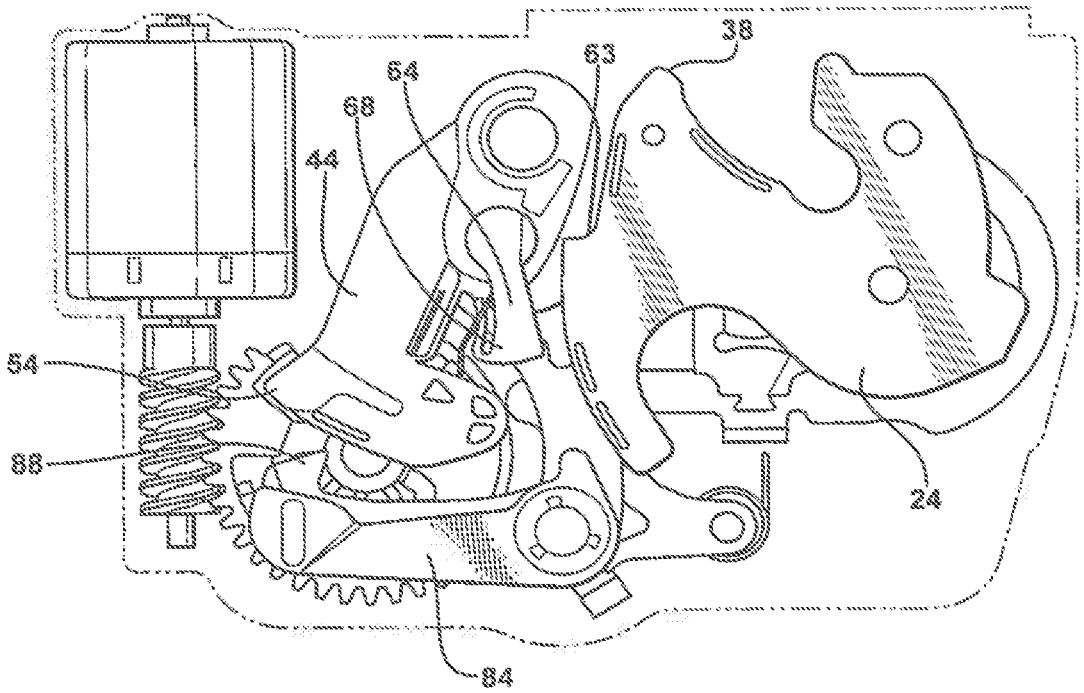
FIG. 9 is a partial front view of the latch in a third partially actuated state of opening.

Next, as shown in the isolated rear image view of FIG. 8 (where gear wheel 146 is shown in phantom), the finger 116 of the secure lock lever 104 begins to ride against the gear wheel circumferential guide surface 170. In addition, the gear wheel push block 148 begins to engage the depending abutment 98 of the secondary pawl 84 to move the secondary pawl 84 into its open or auxiliary ratchet release position. As seen in the isolated front image view of FIG. 9, when the auxiliary ratchet check shoulder 54 clears the secondary pawl hook shoulder 88 the bias force on the auxiliary ratchet 44 and/or reaction to the seal force Fs will typically cause the auxiliary ratchet 44 to spring into its open or disabling position. And when the auxiliary ratchet 44 pivots into its open or disabling position, the primary pawl 64 and its check arm 68 are carried by edge 63 to its open or ratchet release position, following which the ratchet 24 springs into its open or striker release position as shown in FIG. 9.

Figure 10:
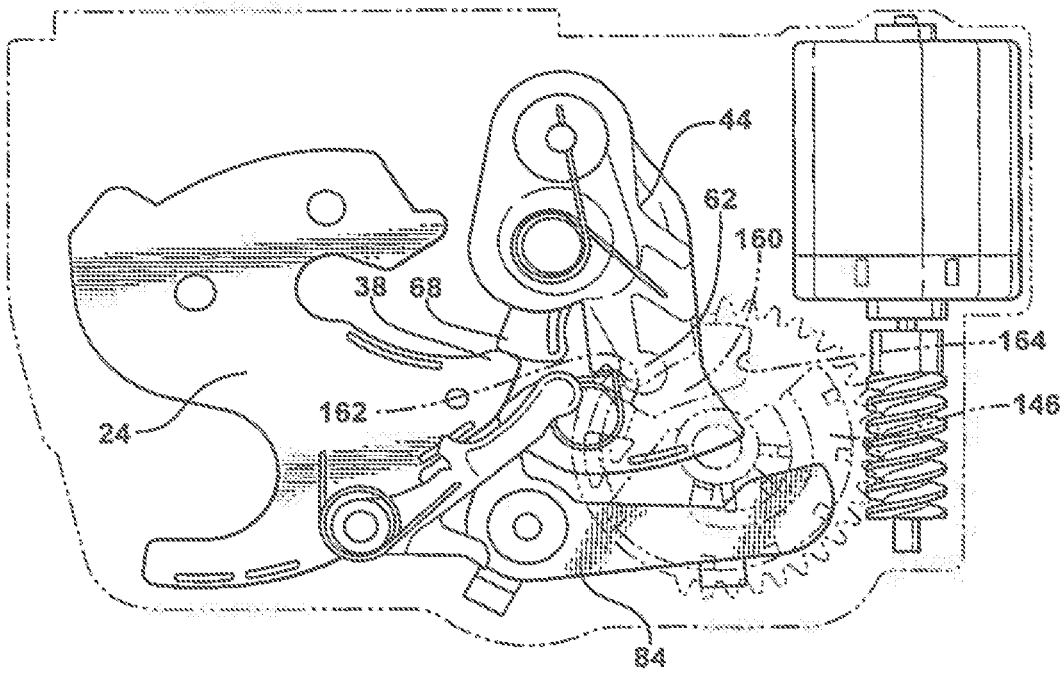
FIG. 10 is a partial rear view of the latch in a fourth partially actuated state of opening.

However, in the event the bias and/or seal force on the auxiliary ratchet 44 is insufficient, the gear wheel 146 can function to force the auxiliary ratchet 44 into its open or disabling position. More particularly as seen in the isolated rear image views of FIGS. 10 and 11 where the gear wheel 146 is shown in phantom, the controller continues to rotate the gear wheel 146 and in the event the auxiliary ratchet 44 has not yet sprung open the radial push surface 162 of the first gear wheel well 160 will, as shown in FIG. 10, begin to engage the depending post 62 of the auxiliary ratchet 44 and, as shown in FIG. 11, urge the auxiliary ratchet 44 into its open or disabling position wherein primary pawl check arm 68 clears ratchet primary shoulder 38 as shown and thus will not inhibit rotation of the ratchet 24 into its open or striker release position due to the biasing and/or seal forces acting thereon.

The controller rotates the gear wheel 146 until a limit is reached where the auxiliary ratchet 44 if moved fully into its open or disabling position. The limit may signaled by use of a limit switch (such as a "door open" switch, handle switch or both), by sensing a current spike as a result of a part hitting a hard limit, or by reaching a specified time for applying power to the motor gear assembly 140. The preferred embodiment employs the switch sensing technique in conjunction with a timeout to avoid unnecessary power consumption, but however the limit is determined when it is reached the controller immediately begins to rotate the gear wheel 146 in the opposite direction to begin a reset operation for the latch before the striker reenters the ratchet 24.

Figure 6A:
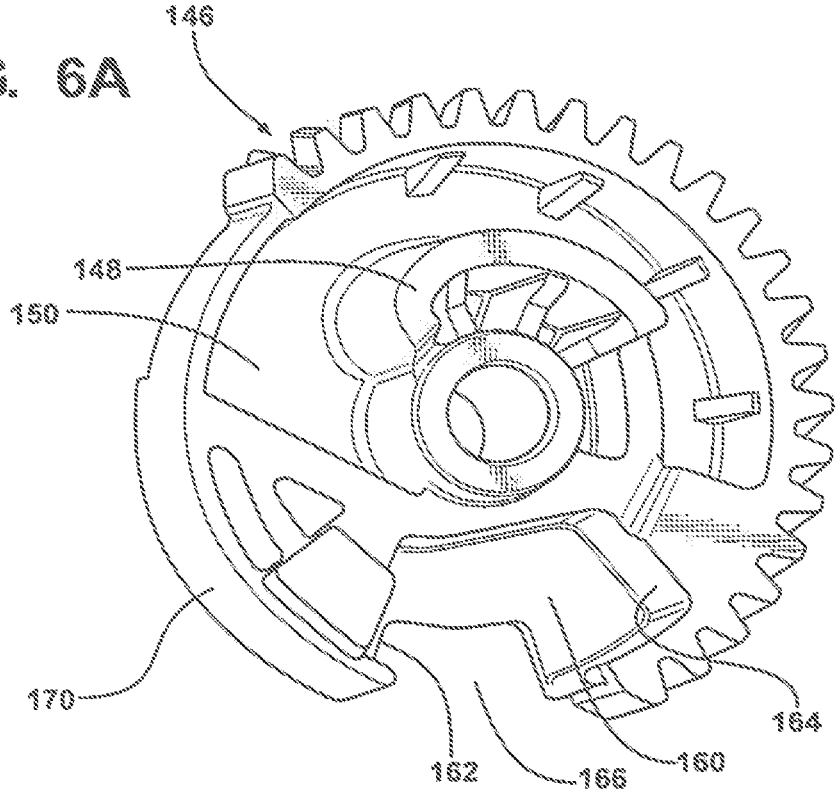
FIG. 6A is a perspective view of the gear wheel in isolation.
Figure 6B:
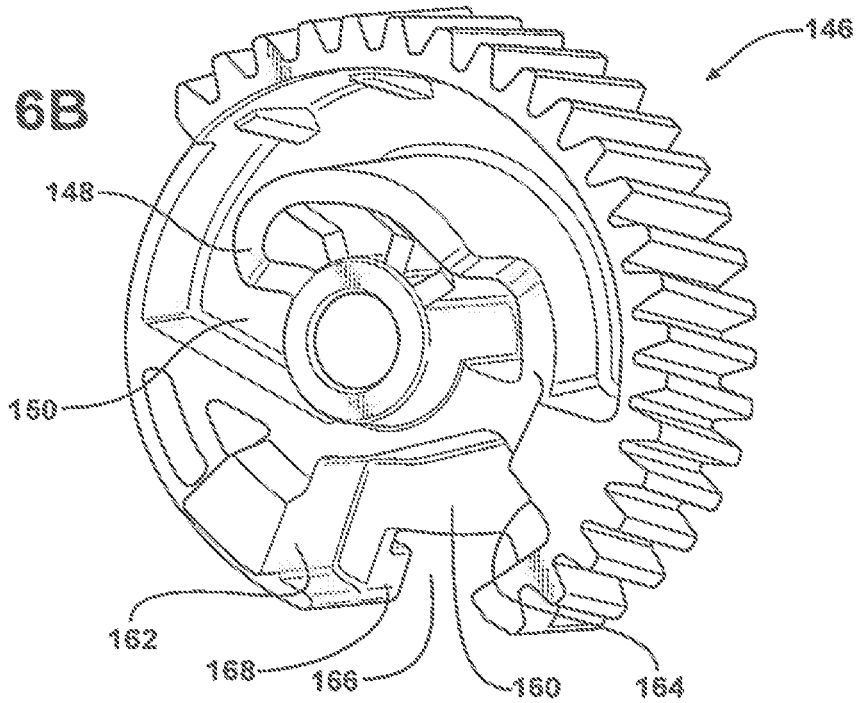
FIG. 6B is a perspective view of the gear wheel in isolation taken from a different point of view than in FIG. 6A.
Figure 11:
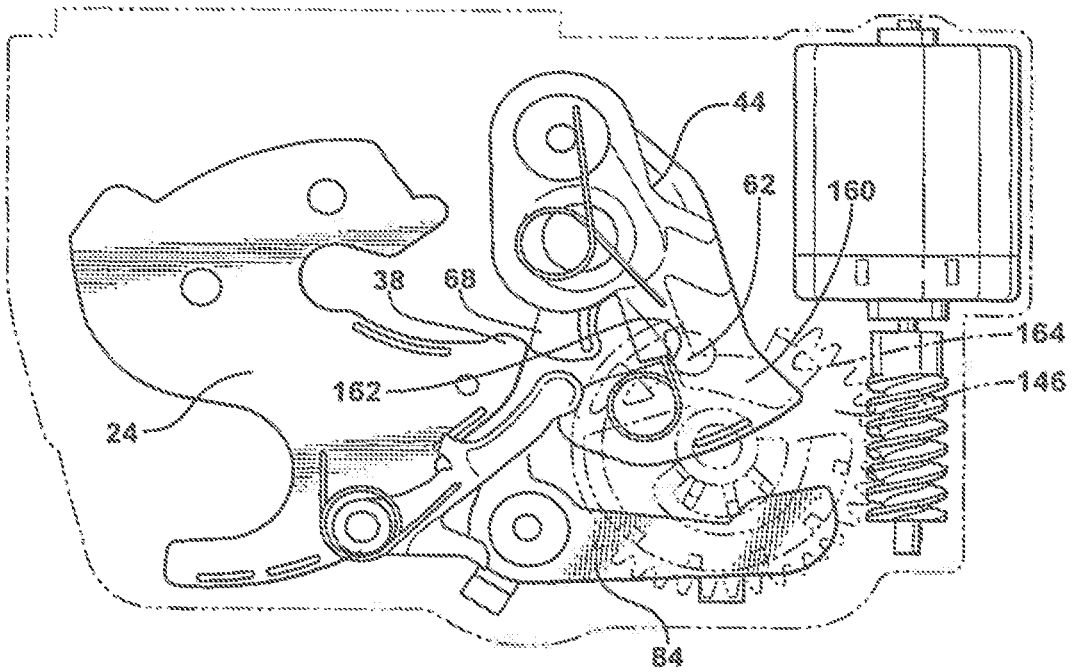
FIG. 11 is a partial rear view of the latch in a fifth partially actuated state of opening.
Figure 12:
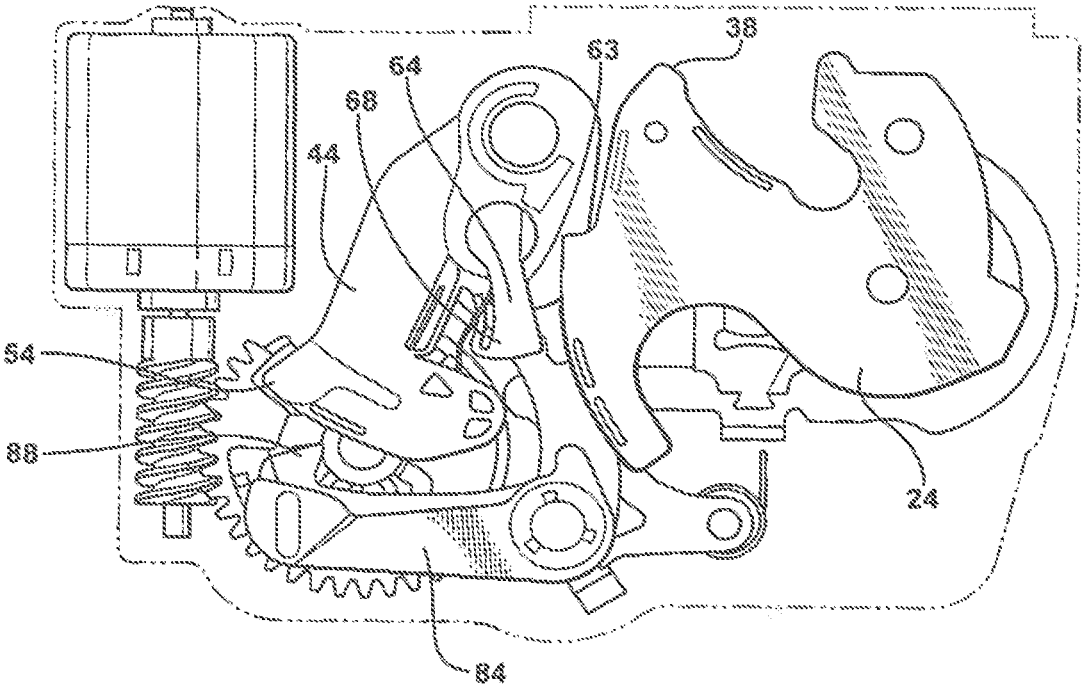
FIG. 12 is a partial front view of the latch in a first partially actuated state of re-setting the latch.

Thus, referring to FIGS. 6B, 11 and 12, after a short lost motion period the opposite radial push surface 164 of the first gear wheel well 160 begins to engage the depending post 62 of the auxiliary ratchet 44 and rotate it back towards its closed or enabling position. In the process the secondary pawl 84 returns to its closed or auxiliary ratchet holding position as a result of the bias force on the secondary pawl 84 as the gear wheel push block 148 (which engages the secondary pawl depending abutment 98) moves back to its initial state.

It should also be noted that in the event the bias force on the secondary pawl is for some reason insufficient to return the secondary pawl 84 to its closed or auxiliary ratchet holding position (or to return it quickly enough), the motion of the auxiliary ratchet 44, which is driven by the gear wheel 146, can accomplish this function. In particular the cam lip 56 of the auxiliary ratchet anvil 52 is configured to engage the protrusion 90 of the secondary pawl in order to pivot and force the secondary pawl 84 back to its closed or auxiliary ratchet holding position. Thus the gear assembly 140 is operative to kinematically act on the secondary pawl 84 to move the secondary pawl to its closed or auxiliary ratchet holding position during latch reset.

At the end of the gear wheel return travel, the secure lock lever 104 also returns to its locking position (see FIG. 1B) as the bulbous end 118 of the secure lock lever finger 116 is caught in the second well 166 causing thumb 108 to align with secondary pawl tab 92 and block any opening motion of the secondary pawl 84.

Figure 13:
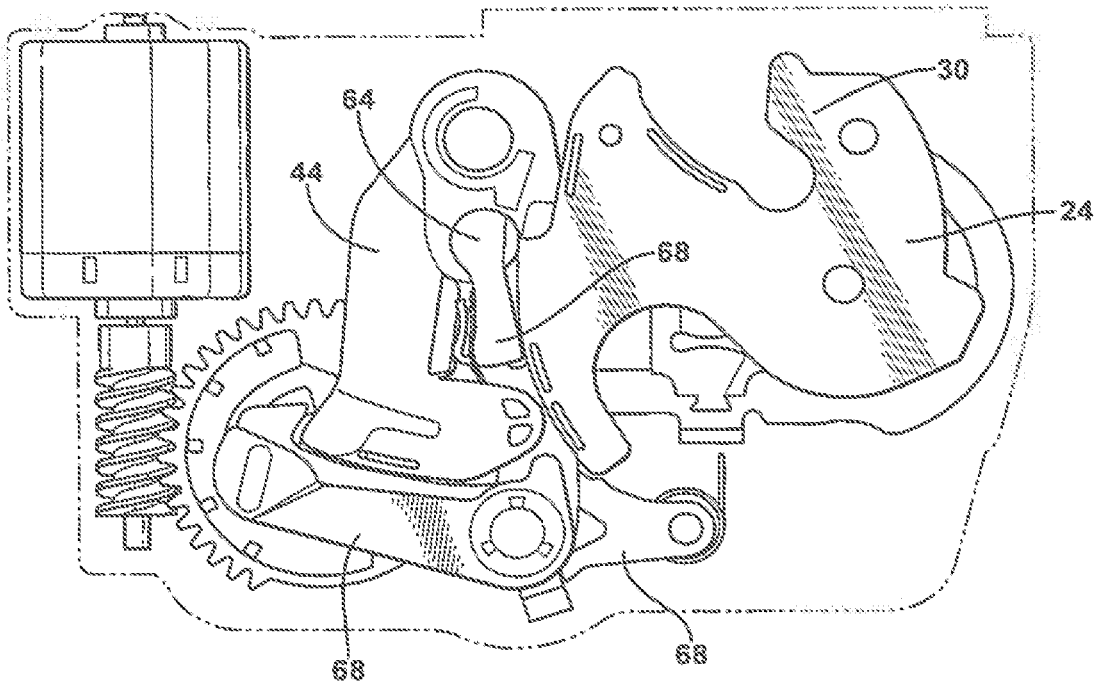
FIG. 13 is a partial front view of the latch in a second partially actuated state of re-set.

Consequently at the termination of the reset process, as shown in FIG. 13, the auxiliary ratchet 44 is moved to its closed or enabling position, the secondary pawl 84 is moved to its closed or aux ratchet blocking position and the secure lock lever 104 is moved to its locking position. However, the primary pawl 64 is not yet in its closed or ratchet checking position since the check arm 68 merely brushes up against an open ratchet 24. Only when the vehicle is door is closed and the striker reenters the ratchet hook or claw 30 will the ratchet 24 rotate to its closed or striker retaining portion, enabling the bias force present on the primary pawl 64 to move the check arm 68 into blocking position with the ratchet primary shoulder 38 as shown in FIG. 1A (or secondary shoulder 40 in the event of a weakly closed door.)

The sequence of resetting the latch immediately upon opening has benefits in that in the process of later closing the latch the only moving parts are the ratchet 24 and primary pawl 64, the movements of which have relatively low noise. More importantly, there is no need to synchronize the movement any parts upon closing the latch which could occur very quickly or slowly depending on how fast the vehicle door is closed. The latch is thus not speed sensitive, and thus it is possible to avoid such problems in resetting the latch during closing.

Figure 2A:
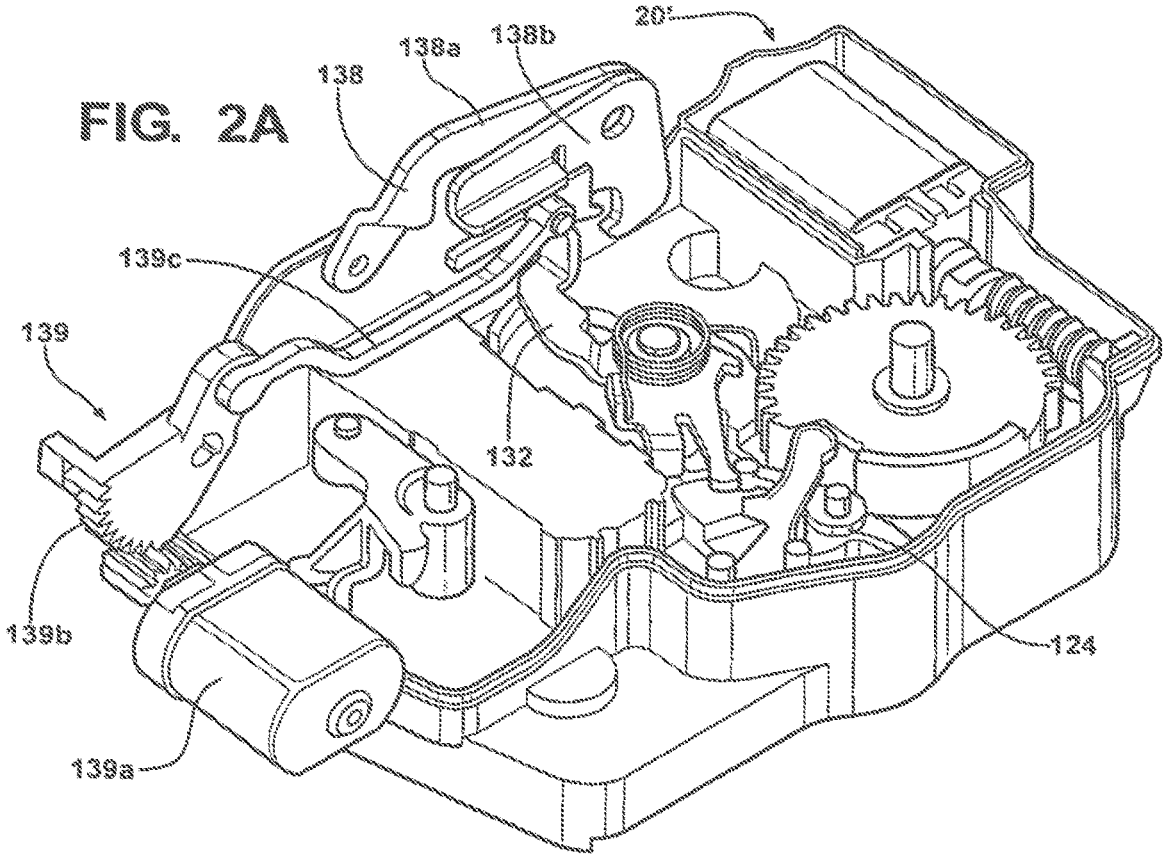
FIG. 2A is a rear perspective view of an alternative embodiment of the latch with a rear cover removed from view.
Figure 2B:
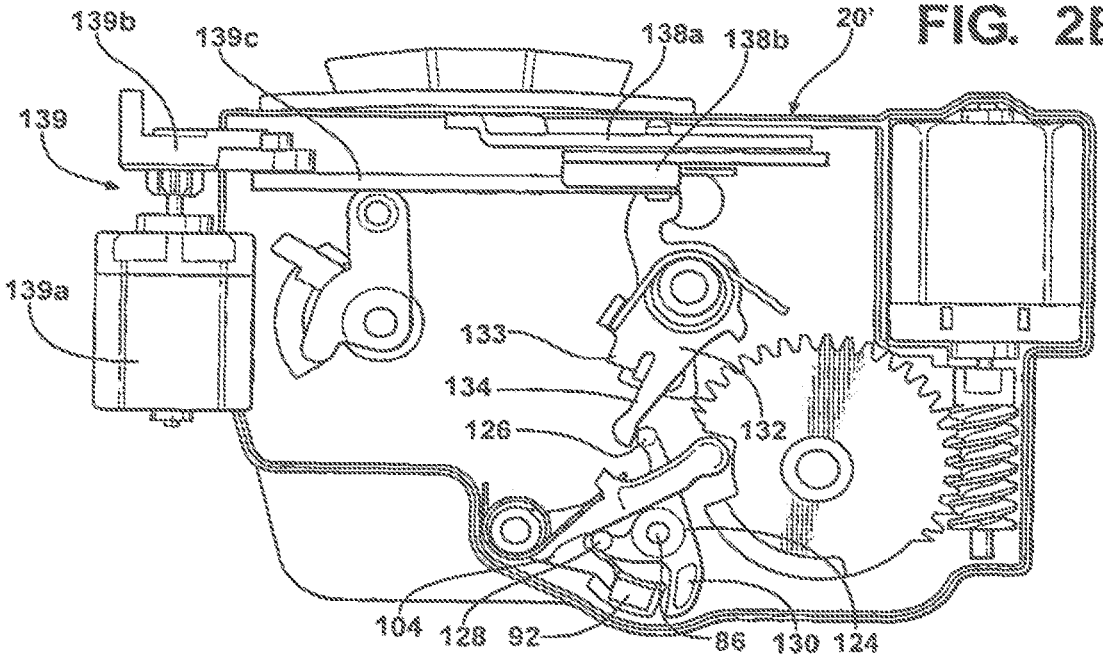
FIG. 2B is a rear plan view of the alternative embodiment with the rear cover removed from view.

FIGS. 2A and 2B show an alternative embodiment of a latch 20', where like parts are labeled with the same reference numbers as latch 20. The latch 20' includes additional mechanism for releasing the secure lock lever 104 from its locked position. The mechanism include an emergency release lever 124, rotationally mounted to pin 86, having three limbs 126, 128 and 130, and an intermediate emergency release lever 132, rotationally mounted to a pin integrated on the latch housing, having two limbs 134 and 136. The levers 124, 126 are kinematically connected via inter-engaging limbs 126 and 134, such that actuation of the intermediate release lever 132 in the counterclockwise direction (having reference to the orientation of FIG. 2B) causes the emergency release lever 124 to rotate clockwise (having reference to the orientation of FIG. 2B), whereby limb 128 pushes the secure lock lever 104 out of its locking position and limb 130 engages the bent tab 92 of the secondary pawl 84 to actuate it into its open or auxiliary ratchet release position. The intermediate release lever 132 also has an appendage 133 that engages and actuates the primary pawl into its open or ratchet release position. Thus, the additional release mechanism guarantees release of the vehicle door and precludes it from re-closing.

The intermediate emergency release lever 132 may be actuated by one or more optional levers as follows. First, an inside release lever 138 may be provided in the latch 20' and connected by Bowden cable to an inside handle (not shown). The inside release lever 138 is directly connected to the intermediate emergency release lever 132 to actuate it. This option may be suitable for an electric latch with a manual back-up from a conventional inside handle. Alternatively, an access hole (not shown) may be provided in the latch to enable service personnel to manually move the inside release lever 138 with a tool such as screwdriver. This option may be suitable in a full-electric version of latch 20, providing service mechanical emergency release means. Second, the inside release lever 138 may be provided in two parts 138*a* and 138*b*, with the second part 138*b* mounted at a common rotational point with lever 138*a*. The second lever 138*b* directly engages the intermediate release lever 132 and is selectively coupled or uncoupled with the first lever 138*a* by a link mechanism 139 comprising a motor 139*a*, gear train 139*b*, and sliding link 139*c*. The link mechanism 139 provides a double lock function, disabling the inside release lever 138 by selectively de-coupling the first lever 138*a* from the second lever 138*b*. This option may be suitable where a dead lock or child lock function is desired.

While the above describes a particular embodiment(s) of the invention, it will be appreciated that modifications and variations may be made to the detailed embodiment(s) described herein without departing from the spirit of the invention.

The invention claimed is:

1. A vehicle latch, comprising:

a ratchet movable between a striker release position whereat the ratchet is positioned to receive a striker and a striker capture position whereat the ratchet is positioned to retain the striker, the ratchet being biased towards its striker release position;

a primary pawl movable between a ratchet checking position whereat the primary pawl is positioned to keep the ratchet in its striker capture position and a ratchet release position whereat the primary pawl permits movement of the ratchet out of its striker capture position, the primary pawl being biased towards its ratchet checking position;

an auxiliary ratchet operatively connected to the primary pawl, the auxiliary ratchet being movable between an enabling position whereat the primary pawl is enabled to move to its ratchet checking position and a disabling position whereat the auxiliary ratchet positions the primary pawl in its ratchet release position;

a secondary pawl movable between an auxiliary ratchet holding position whereat the secondary pawl is positioned to hold the auxiliary ratchet in its enabling position and an auxiliary ratchet release position whereat the secondary pawl is positioned to permit movement of the auxiliary ratchet to its disabling position, the secondary pawl being biased towards its auxiliary ratchet holding position;

a drive mechanism operable in a first operative direction to open the latch by causing the secondary pawl to move to its auxiliary ratchet release position which permits the auxiliary ratchet to move to its disabling position such that the primary pawl is moved to its ratchet release position and the ratchet is permitted to move to its striker release position, the drive mechanism operable in a second operative direction to reset the latch by causing the auxiliary ratchet to move to its enabling position and causing the secondary pawl to move to its auxiliary ratchet holding position; and a controller for controlling operation of the drive mechanism, the controller causing the drive mechanism to operate in the second operative direction to reset the latch in response to the ratchet being located in its striker release position.

2. The vehicle latch according to claim 1, wherein the drive mechanism includes an electric motor controlled by the controller, and a gear wheel rotatably driven by the electric motor in the first operative direction to open the latch and in the second operative direction to reset the latch.

3. The vehicle latch according to claim 2, wherein the controller actuates the electric motor to drive the gear wheel in the first operative direction for causing the gear wheel to engage the secondary pawl and move the secondary pawl from its auxiliary ratchet holding position into its auxiliary ratchet release position, wherein movement of the secondary pawl to its auxiliary ratchet release position causes the secondary pawl to disengage the auxiliary ratchet and permit an auxiliary ratchet biasing spring to urge the auxiliary ratchet to move from its enabling position into its disabling position for moving the primary pawl from its ratchet checking position into its ratchet release position, and wherein a ratchet biasing spring urges the ratchet to move from its striker capture position into its striker release position so as to open the latch.

4. The vehicle latch according to claim 3, wherein the controller actuates the electric motor to drive the gear wheel in the second operative direction for causing the gear wheel to engage the auxiliary ratchet and move the auxiliary ratchet from its disabled position into its enabling position, and wherein continued rotation of the gear wheel in the second operative direction causes the gear wheel to engage the secondary pawl and move the secondary pawl from its auxiliary ratchet position into its auxiliary ratchet holding position whereat the secondary pawl is positioned to hold the auxiliary ratchet in its enabling position so as to reset the latch.

5. The vehicle latch according to claim 4, wherein movement of the ratchet from its striker release position to its striker capture position permits the primary pawl to move from its ratchet release position to its ratchet holding position so as to lock the latch following reset of the latch.

6. The vehicle latch according to claim 4, wherein the controller causes the electric motor to rotate the gear wheel in the first operative direction until a limit is reached with the auxiliary ratchet located in its disabling position and the ratchet being located in its striker release position.

7. The vehicle latch according to claim 6, wherein the limit is signaled to the controller by a signal from a limit switch.

8. The vehicle latch according to claim 7, wherein the limit switch is a door open switch providing a door open signal to the controller indicative of the ratchet being located in its striker release position.

9. The vehicle latch according to claim 6, wherein the limit is expiration of a predetermined time of applying power to the electric motor.

10. A vehicle latch according to claim 1, wherein the drive mechanism is controlled to: first move the secondary pawl into its auxiliary ratchet release position, and, if required, move the auxiliary ratchet to its disabling position, whereby the ratchet is permitted to move into its striker release position; and then, prior to the ratchet moving to its striker capture position, immediately reset the latch by moving the auxiliary ratchet to its enabling position and enabling the secondary pawl to move into its auxiliary ratchet holding position.

11. A vehicle latch according to claim 2, wherein the gear wheel has a well formed therein, wherein a secure lock lever has a first portion and a second portion, wherein when the second portion is positioned in the gear wheel well the first portion blocks the secondary pawl from movement out of its auxiliary ratchet holding position, and when the second portion is moved out of the gear wheel well by rotation of the gear wheel in the first operative direction the first portion does not block the secondary pawl from movement toward its auxiliary ratchet release position.

12. The vehicle latch according to claim 1, wherein the primary pawl is pivotally mounted to the auxiliary ratchet.

13. The vehicle latch according to claim 12, wherein the auxiliary pawl is pivotal about a first axis, and wherein the primary pawl is pivotally mounted to the auxiliary pawl about a second axis that is offset from the first axis.

14. A vehicle latch, comprising:

a ratchet movable between a striker release position whereat the ratchet is positioned to receive a striker and a striker capture position whereat the ratchet is positioned to retain the striker, the ratchet being biased towards its striker release position;

a primary pawl movable between a ratchet checking position whereat the primary pawl is positioned to hold the ratchet in its striker capture position and a ratchet release position whereat the primary pawl permits the movement of the ratchet out of its striker capture position;

an auxiliary ratchet operatively connected to the primary pawl, the auxiliary ratchet being movable between an enabling position whereat the primary pawl is enabled to move to its ratchet checking position and a disabling position whereat the auxiliary ratchet locates the primary pawl in its ratchet release position;

a secondary pawl movable between an auxiliary ratchet holding position whereat the secondary pawl is positioned to hold the auxiliary ratchet in its enabling position and an auxiliary ratchet release position whereat the secondary pawl is positioned to permit movement of the auxiliary ratchet to its disabling position; and a drive mechanism operable in a first operative direction to open the latch by causing the secondary pawl to move to its auxiliary ratchet release position which permits the auxiliary ratchet to move to its disabling position and locate the primary pawl in its ratchet release position such that the ratchet is permitted to move to its striker release position, the drive mechanism operable in a second operative direction to reset the latch by causing the auxiliary ratchet to move to its enabling position and causing the secondary pawl to move to its auxiliary ratchet holding position in response to movement of the ratchet to its striker release position.

15. The vehicle latch according to claim 14, wherein the drive mechanism includes an electric motor controlled by a controller, and a gear wheel rotatably driven by the electric motor in the first operative direction to open the latch and in the second operative direction to reset the latch, wherein the controller actuates the electric motor to drive the gear wheel in the first operative direction for causing the gear wheel to engage the secondary pawl and move the secondary pawl from its auxiliary ratchet holding position into its auxiliary ratchet release position, wherein movement of the secondary pawl to its auxiliary ratchet release position causes the secondary pawl to disengage the auxiliary ratchet and permit an auxiliary ratchet biasing spring to urge the auxiliary ratchet to move from its enabling position into its disabling position for moving the primary pawl from its ratchet checking position into its ratchet release position, and wherein a ratchet biasing spring urges the ratchet to move from its striker capture position into its striker release position so as to open the latch.

16. The vehicle latch according to claim 15, wherein the controller actuates the electric motor to drive the gear wheel in the second operative direction in response to a signal indicative of the ratchet being located in its striker release position for causing the gear wheel to engage the auxiliary ratchet and move the auxiliary ratchet from its disabled position into its enabling position, and wherein continued rotation of the gear wheel in the second operative direction causes the gear wheel to engage the secondary pawl and move the secondary pawl from its auxiliary ratchet position into its auxiliary ratchet holding position whereat the secondary pawl is positioned to hold the auxiliary ratchet in its enabling position so as to reset the latch.

17. The vehicle latch according to claim 16, wherein movement of the ratchet from its striker release position to its striker capture position permits the primary pawl to move from its ratchet release position to its ratchet holding position so as to lock the latch following reset of the latch.

18. The vehicle latch according to claim 15, wherein the controller causes the electric motor to rotate the gear wheel in the first operative direction until a limit is reached with the auxiliary ratchet located in its disabling position and the ratchet located in its striker release position.

19. The vehicle latch according to claim 18, wherein the limit is signaled to the controller by an open door signal from a limit switch detecting the position of the ratchet.

20. A vehicle latch, comprising:

a ratchet moveable between a striker release position whereat the ratchet is positioned to receive a striker and a striker capture position whereat the ratchet is positioned to retain the striker, the ratchet being biased towards its striker release position;

a primary pawl movable between a ratchet checking position whereat the primary pawl is positioned to hold the ratchet in its striker capture position and a ratchet release position whereat the primary pawl permits the movement of the ratchet out of its striker capture position, the primary pawl being biased towards the ratchet checking position;

an auxiliary ratchet operatively connected to the primary pawl, the auxiliary ratchet being movable between an enabling position whereat the primary pawl is enabled to move to its ratchet checking position and a disabling position whereat the auxiliary ratchet locates the primary pawl to its ratchet release position;

a secondary pawl movable between an auxiliary ratchet holding position whereat the secondary pawl is positioned to hold the auxiliary ratchet in its enabling position and an auxiliary ratchet release position whereat the secondary pawl is positioned to permit movement of the auxiliary ratchet to its disabling position, the secondary pawl being biased to the auxiliary ratchet holding position;

a drive mechanism having an electric motor rotatably driving a gear wheel in a first operative direction to open the latch by causing the secondary pawl to move to its auxiliary ratchet release position which permits the auxiliary ratchet to move to its disabling position such that the primary pawl is moved to its ratchet release position and the ratchet is permitted to move to its striker release position, the electric motor driving the gear wheel in a second operative direction to reset the latch by causing the auxiliary ratchet to move to its enabling position and causing the secondary pawl to move to its auxiliary ratchet holding position; and a controller operable to control actuation of the electric motor for controlling the rotary direction of the gear wheel, wherein the electric motor rotates the gear wheel in the second operative direction when a limit is reached with the ratchet located in its striker capture position, and wherein the limit provides an open door signal to the controller.

* * * * *